US006286429B1

(12) United States Patent
Marietta et al.

(10) Patent No.: US 6,286,429 B1
(45) **Date of Patent: *Sep. 11, 2001**

(54) FIREWORKS LAUNCHER

(76) Inventors: John Marietta, 817 S. 200, Pittsburgh, KS (US) 66762; Tom Crablen, 1412 Willow Rd., Pryor, OK (US) 74361

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/350,022

(22) Filed: Jul. 9, 1999

Related U.S. Application Data

(63) Continuation-in-part of application No. 29/095,411, filed on Oct. 22, 1998.

(51) Int. Cl.[7] ..... F42B 4/04; F42B 4/28
(52) U.S. Cl. ..... 102/342; 102/351; 102/361
(58) Field of Search ..... 102/342, 345, 102/361, 351

(56) References Cited

U.S. PATENT DOCUMENTS

| | | | |
|---|---|---|---|
| D. 25,275 | 3/1896 | Ives | 102/361 |
| D. 164,423 | 9/1951 | Howell | 102/361 |

(List continued on next page.)

OTHER PUBLICATIONS

Representation of fireworks tube launch assembly with cardboard tube and plastic base asserted by Ingram Enterprises, Inc. to have been made and sold since the 1970's.

Representation of plastic base used in fireworks launch assemblies asserted by Ingram Enterprises, Inc. to have been made and sold since the 1970's.

Representation of 2 and ½ O.D. multiple fireworks launch tube with compressed paper board tube and plastic support base asserted by Ingram Enterprises, Inc. to have been made and sold since the 1970's.

Representation of plastic support base with circular channel for use with 2 and ½ O.D. launch tube asserted by Ingram Enterprises, Inc. to have been made and sold since 1970's.

PGI Bulletin No. 54; Winter 12986–87, pp. 5–10, entitled "HDPE MORTARS FOR ELECTRICALLY FIRED DISPLAYS".

(List continued on next page.)

*Primary Examiner*—Peter A. Nelson
(74) *Attorney, Agent, or Firm*—Hovey, Williams, Timmons & Collins

(57) ABSTRACT

A longitudinal launcher tube made substantially of polyurethane resin or plastic having a rear end closed by a transverse rear wall and an open front end. The invention allows a projectile to be housed in the tube and adapted to slide longitudinally inside it towards the front, to be expelled from it via the front end tube, means for defining with the tube and projectile a rear gas expansion chamber immediately to the rear of the projectile, and an impulse cartridge adapted on command to develop gas pressure in the rear chamber to cause the expulsion of the projectile via the front end of the tube. The apparatus is a pyrotechnic device for rigidly supporting fireworks such as mortar-type, rocket-type, projectile-type, and other pyrotechnic devices so that the launcher device is reusable, whereby the launcher substantially retains its integrity after each launch to minimize harm caused to persons and the environment.

16 Claims, 1 Drawing Sheet

U.S. PATENT DOCUMENTS

| | | | | |
|---|---|---|---|---|
| 234,132 | | 11/1880 | Keyser | 102/34.2 |
| 1,770,921 | | 7/1930 | Hitt | 102/361 |
| 1,773,197 | | 8/1930 | Mulcahy | 102/361 |
| 1,922,081 | | 8/1933 | Driggs, Jr. | 102/34.2 |
| 2,103,936 | | 12/1937 | Decker | 102/361 |
| 2,821,922 | | 2/1958 | Brown et al. | 102/342 |
| 3,145,530 | | 8/1964 | Sobey | 102/33 |
| 3,227,084 | | 1/1966 | Stokes et al. | 102/361 |
| 3,404,782 | | 10/1968 | Ray | 211/49 |
| 4,566,388 | * | 1/1986 | Loyd, Jr. | 102/361 |
| 4,697,518 | | 10/1987 | Lau et al. | 102/358 |
| 4,724,768 | | 2/1988 | Robinson et al. | 102/349 |
| 4,771,695 | | 9/1988 | Simpson | 102/343 |
| 4,917,015 | * | 4/1990 | Lowery | 102/361 X |
| 5,149,912 | | 9/1992 | Waidner et al. | 102/343 |
| 5,249,528 | | 10/1993 | Lee | 102/361 |
| 5,339,741 | | 8/1994 | Craven et al. | 102/361 |
| 5,429,053 | | 7/1995 | Walker | 102/342 |
| 5,526,750 | | 6/1996 | Poor et al. | 102/361 |
| 5,567,907 | * | 10/1996 | Westfall | 102/361 X |
| 5,623,113 | | 4/1997 | Valembois | 89/1.817 |
| 5,627,338 | | 5/1997 | Poor et al. | 102/361 |
| 5,739,459 | | 4/1998 | La Mura et al. | 102/217 |
| 5,739,462 | | 4/1998 | Poor et al. | 102/342 |
| 5,979,329 | * | 11/1999 | Collar | 102/361 |

OTHER PUBLICATIONS

Quotation dated Mar. 27, 1987 from Poly Pipe Industries, Inc. to Austin Fireworks.

Poly Pipe price sheet (undated) HDPE poly pipe.

Article from American Fireworks News (undated) entitled Destructive Testing and Field Experience with HDPE Mortars.

Article entitled "Laser welding offers cleanliness, speed, and noncontact benefits".

Branson Ultrasonics Corporation article entitled "Ultrasonic Staking" dated 1980.

Branson timeline entitled "Ultrasonis Sequence Time Line".

Branson article entitled "Ultrasonic Stud Welding" dated 1978.

Sonics Ultrasonics brochure of Sonics & Materials, Inc. dated 1998.

* cited by examiner

FIREWORKS LAUNCHER

CROSS REFERENCE TO RELATED APPLICATIONS

This invention is a continuation-in-part of patent application Ser. No. 29/095,411 filed Oct. 22, 1998.

FIELD OF THE INVENTION

The present invention relates to a reusable fireworks device for launching at least one projectile. More particularly, a longitudinal launcher tube made substantially of high density polyethylene, polyurethane, resin, or plastic having a rear end closed by a transverse rear wall and an open front end. The apparatus is a pyrotechnic device for rigidly supporting fireworks such as mortar-type, rocket-type, projectile-type, and other pyrotechnic devices so that the launcher device is reusable, whereby the launcher substantially retains its integrity after each launch to minimize harm caused to persons and the environment surrounding the pyrotechnic devices.

BACKGROUND OF THE INVENTION

Launch devices of this type are well known in implementations in which the impulse cartridge is housed in or communicates as directly as possible with the rear chamber, which is integrated into either the rear wall of the launcher tube or the rear of the projectile. Previous launchers for fireworks were made of paper or cardboard. The launchers of this type would either be destroyed or could not safely be reused to launch additional pyrotechnic devices. The concepts of front and rear are to be understood with reference to the predetermined direction of displacement of the projectile relative to the tube on firing. Heretofore, reusable launchers were made of metal, i.e. cast iron, tin, or aluminum. The use of metals substantially elevate the cost of manufacture due to the cost of labor and material. Additionally, launchers made of cardboard, wood, or other materials substantially lost their integrity due to the intense heat and pressures of the initial launch. The tubes and base were either glued or stapled together, which quickly separated upon expulsion of the projectile. Patents which view and characterize the configurations above are listed below.

U.S. Pat. No. 234,132 issued to Keyser discloses a detachable cast-iron mortar and stand used to cause a projectile to be launched. U.S. Pat. No. 1,922,081 issued to Driggs, Jr. discloses a fireworks display article having two explosions, the first on the ground and the second in the air.

U.S. Pat. No. 2,821,922 issued to Brown et al. shows a rocket toy consisting of a cylindrical tube wherein one end is closed by a flat perpendicular plug.

U.S. Pat. No. 4,917,015 issued to Lowery discloses a fireworks launch pad for holding and aiming a rocket. The pad comprises a rocket receiving member which slidably receives and aims the rocket.

U.S. Pat. No. 5,567,907 issued to Westfall discloses a fireworks support structure with the lower end of the support stake placed adjacent to the earth and the support stake is firmly implanted into the earth.

U.S. Pat. No. 5,249,528 issued to Lee discloses a fireworks kit having a first tube reciprocably mounting a second tube, wherein the first tube has an ejector rod which is connected to the first and second tubes to permit ejection of the fireworks.

Therefore, it is a principal object of the present invention to provide a reusable launching device for fireworks.

Another object of the invention is to provide a launching device where after a launch the device substantially retains its integrity.

An object of the invention is to provide a multiple launch device made of polyurethane, resin or plastic.

An object of the invention is to provide a reusable multiple launch device which is inexpensive to manufacture.

Yet another object of this invention is to provide a reusable multiple launch device which is safe for the environment and participants surrounding the launch.

Finally, it is an object of this invention to provide a launching device which assists the fireworks in a directed flight.

These and other objects of the present invention will become apparent and will be more fully understood upon reading the following specification and referring to the accompanying drawings, which form a material part of this disclosure.

SUMMARY OF THE INVENTION

The present invention provides a launcher for the multiple launching of pyrotechnic compounds or projectiles. The inventor has overcome the problems associated with providing a low cost reusable launcher for fireworks by using a launcher made of polyurethane with the base and tube constructed in such away as to withstand the pressures of continuous launchings. The launcher comprises a high density polyurethane launch tube and base, which are heat fused together. This combination allows the launcher to withstand the heat and pressures of a launch without substantial degradation to the launcher. Moreover, the launcher can be reused up to 24 times for launching fireworks.

Other features and advantages of the present invention will be apparent from the following description in which the preferred embodiments have been set forth in conjunction with the accompanying drawings

BRIEF DESCRIPTION OF THE DRAWINGS

In describing the preferred embodiments of the invention, reference will be made to the series of figures and drawings briefly described below.

There may be additional structures described in the foregoing application which are not depicted on one of the described drawings. In the event such a structure is described but not depicted in a drawing, the absence of such a drawing should not be considered as an omission of such design from the specification.

THE PRESENT INVENTION

Figure 1:
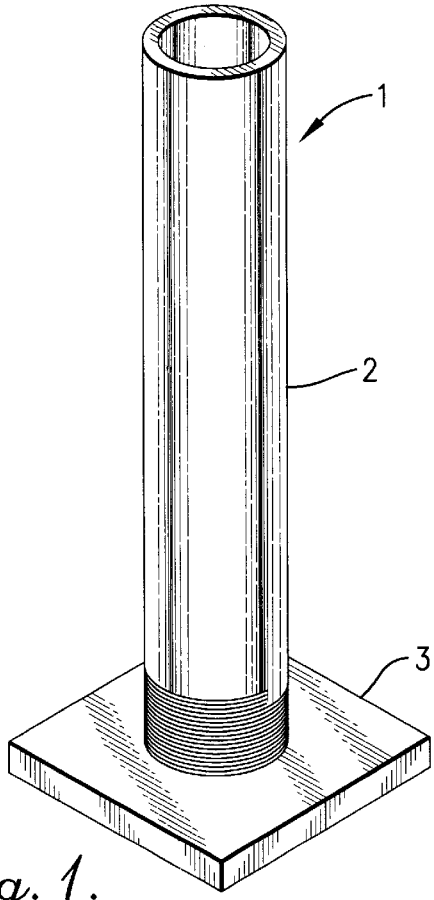
FIG. 1 shows the reusable fireworks launcher.
Figure 2:
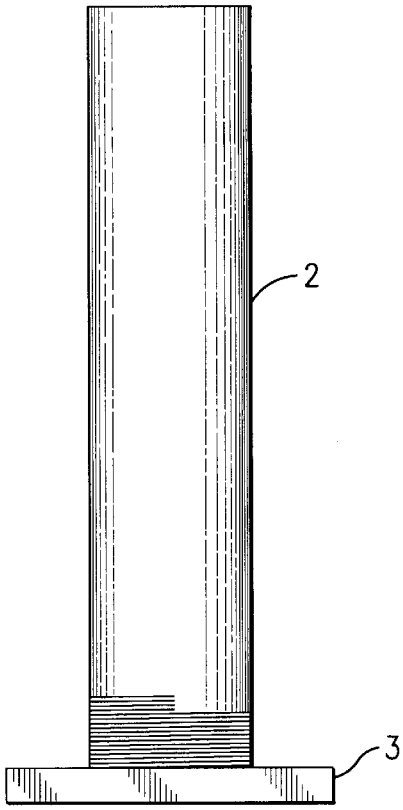
FIG. 2 shows a side view of the reusable fireworks launcher.
Figure 3:
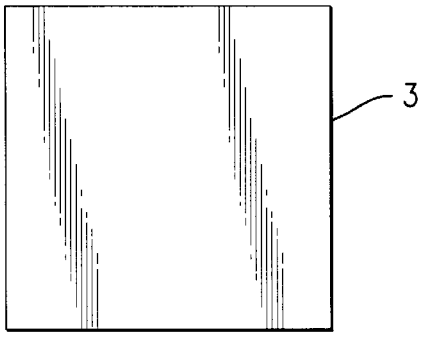
FIG. 3 shows the bottom view of the fireworks launcher.
Figure 4:
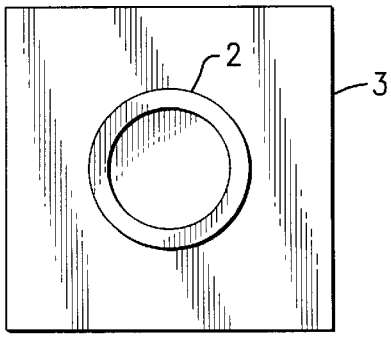
FIG. 4 shows the top view of the fireworks launcher.

Referring to FIGS. 1 and 2, the fireworks launcher (1) consists of a launch member (2) and base (3). The launch member (2) is attached to the base (3) by forcing it to the base until the base and tube are fused. In addition, the launch member (2) is tubular in shape and made of either molded or extruded polyethylene to a thickness in the range of 0.05 mm to 1.5 mm. This provides the strength necessary for the launch tube (2) to withstand the pressures consistent with 24 launches and remain relatively inexpensive to manufacture.

The base (3) is a solid piece of polyurethane or high density polyethylene made in the shape of either a square or rectangle.

THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Figure 5:
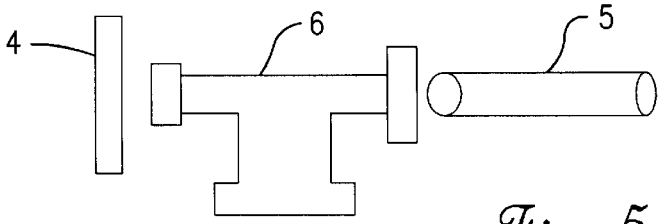
FIG. 5 shows the invention prior to assembly.

As shown in FIG. 5, the invention is assembled so that the connection between the base (4) and the launch tube (5) can withstand the pressures of multiple launchings. The method of assembly requires the cutting of polyurethane pipe to create the launch tube (5). A solid piece of polyurethane is cut to either a square or rectangle creating the base. The base (4) has a thickness in the range between 1.3 mm to 2 mm. The tube (5) and base (4) are cleaned and smoothed at the ends. Both the base (4) and the tube (5) are heated with a special heating element (6) until the heating element is able to freely move against the ends of the base (4) and tube (5). The base (4) and tube (5) are removed from the heating element and the heated tube (5) end is put in contact with the base (4). Pressure (1 to 5 pounds) is applied to both the tube (5) and base (4) thereby fusing the ends together.

Further modification and variation can be made to the disclosed embodiments without departing from the subject and spirit of the invention as defined in the following claims. Such modifications and variations, as included withint the scope of these claims, are meant to be considered part of the invention as described.

What is claimed is:

1. An apparatus for launching a pyrotechnic device, said apparatus comprising:

a tube having a top and a bottom end, and an inner and outer wall surface; and a base having top and bottom surfaces, said top surface and said bottom end of said tube being fused to one another to thereby interconnect the tube and base.

2. The apparatus as recited in claim 1, wherein said tube and base are constructed of a material selected from the group consisting of polyurethane, plastic and resin.

3. A method of constructing a launch apparatus for a pyrotechnic device, said method comprising the steps of:

(a) heating the bottom end of an elongated tube;

(b) heating at least a portion of the top surface of a base;

(c) interengaging the bottom end of the tube and said at least a portion of the top surface of the base; and (d) applying pressure against the tube and base, thereby fusing the tube and base to one another.

4. The apparatus as recited in claim 1 wherein said tube wall has a thickness between the range of 0.05 mm to 1.5 mm.

5. The apparatus as recited in claim 4 wherein said base has a thickness between the range of 1.3 mm to 2 mm.

6. The method as recited in claim 3, wherein steps (a) and (b) are performed simultaneously.

7. The method as recited in claim 3 wherein said tube has an inner and outer wall surface, and said wall has a thickness between the range of 0.05 mm to 1.5 mm.

8. The method as recited in claim 7 wherein said base has top and bottom surfaces said base has a thickness between the range of 1.3 mm to 2 mm.

9. The method as recited in claim 3, wherein step (c) occurs after steps (a) and (b).

10. The method as recited in claim 3, wherein step (d) including the step of applying pressure until said top end and said bottom surface are cooled.

11. The method as recited in claim 9, wherein step (d) occurs after step (c).

12. The apparatus as recited in claim 1, wherein the top surface of the base is flat and the bottom end of the tube is flush with the top surface of the base.

13. The method as recited in claim 3, wherein step (a) comprises the step of placing the bottom end of the tube against a heating element.

14. The method as recited in claim 13, wherein step (b) comprises the step of placing the top surface of the base against a heating element.

15. The method as recited in claim 3, wherein the base and the tube are provided of synthetic resin.

16. The method as recited in claim 15, wherein the base and the tube are provided of polyethylene.

* * * * *